US006262010B1

(12) United States Patent
Emery et al.

(10) Patent No.: US 6,262,010 B1
(45) Date of Patent: Jul. 17, 2001

(54) PARTICULATE LAUNDRY DETERGENT COMPOSITIONS CONTAINING NONIONIC SURFACTANT GRANULES

(75) Inventors: William Derek Emery; Terry Instone, both of Bebington (GB); Reinhard Kohlus, Vlaardingen (NL); Johannes Hendrikus Langeveld, Vlaardingen (NL); Seeng Djiang Liem, Vlaardingen (NL)

(73) Assignee: Unilever Home & Personal Care USA, a Division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/442,510

(22) Filed: Nov. 18, 1999

(30) Foreign Application Priority Data

Nov. 20, 1998 (GB) ..... 9825560

(51) Int. Cl.[7] ..... C11D 17/00

(52) U.S. Cl. ..... 510/446; 510/349; 510/444; 510/509; 510/531

(58) Field of Search ..... 510/438, 443, 510/444, 445, 452, 349, 356, 360, 361, 362, 476, 470, 441, 531, 509

(56) References Cited

U.S. PATENT DOCUMENTS 3,920,586 11/1975 Bonaparte et al. ..... 252/531

FOREIGN PATENT DOCUMENTS 42 16 775 11/1993 (DE) .
42 29 660 3/1994 (DE) .
195 24 722 1/1997 (DE) .
110 588B 6/1984 (EP) .
242 138 10/1987 (EP) .
643 130 A1 3/1995 (EP) .
0 688 861 12/1995 (EP) .
2 003 913 3/1979 (GB) .
1 591 518 6/1981 (GB) .
1 595 769 8/1981 (GB) .
2 106 482 4/1983 (GB) .
2 309 034 7/1997 (GB) .
8-027498A 1/1996 (JP) .
93 21292A 10/1993 (WO) .
96/06916 3/1996 (WO) .
96/06917 3/1996 (WO) .
97/32002 9/1997 (WO) .
97/32005 9/1997 (WO) .
97/33957 9/1997 (WO) .
98/54278 12/1998 (WO) .
98/54281 12/1998 (WO) .
98/54288 12/1998 (WO) .

OTHER PUBLICATIONS

PCT International Search Report, PCT/EP99/08896.
PCT International Search Report, PCT/EP99/08895.

*Primary Examiner*—Necholus Ogden
(74) *Attorney, Agent, or Firm*—Rimma Mitelman

(57) ABSTRACT

A particulate free-flowing laundry detergent composition comprises at least two different granular components: a granular component containing anionic surfactant, and a granular nonionic surfactant component comprising from 20 to 30 wt % of nonionic surfactant on a non-spray-dried particulate carrier material comprising sodium sesquicarbonate. The nonionic surfactant component is preferably prepared by in-situ neutralisation of sodium carbonate with a water-soluble organic acid in the presence of the nonionic surfactant, in a high- or moderate-shear mixer.

18 Claims, No Drawings

PARTICULATE LAUNDRY DETERGENT COMPOSITIONS CONTAINING NONIONIC SURFACTANT GRANULES

TECHNICAL FIELD

The present invention relates to particulate laundry detergent compositions containing anionic surfactants, and nonionic surfactant granules. One embodiment of the invention relates to compositions having good dissolution properties, suitable for washing fabrics at low temperatures and/or by hand, containing a relatively high level of high-foaming anionic surfactant and a relatively low level of nonionic surfactant. Another embodiment of the invention relates to compositions containing sodium percarbonate bleach.

BACKGROUND AND PRIOR ART

Particulate laundry compositions containing both anionic sulphonate- and sulphate-type surfactants and ethoxylated alcohol nonionic surfactants are very well-known. Whilst anionic surfactants such as alkylbenzene sulphonates are very robust and can readily be incorporated into detergent powders both by high-temperature processes, for example, spray-drying, and by lower-temperature non-tower mixing and granulation processes, the options for incorporating nonionic surfactants are more limited, especially for the more hydrophobic ethoxylates having a low degree of ethoxylation. These are not generally incorporated in significant quantities into slurries and spray-dried because of emission problems. In non-tower granulated powders, combination of nonionic surfactants in significant quantities with anionic surfactants, builders and other ingredients in a base granule has led to problems of poor dispersion and dissolution in the wash, possibly due the formation of gel-like liquid crystal phases.

It is therefore desirable to add nonionic surfactant to granular detergent compositions made by both tower (spray-drying) and non-tower processes after the base granulates (base powders) have been formed. The lower-ethoxylated nonionic surfactants are liquids or waxy solids at ambient temperature and can be sprayed onto the base powder. This works well if the loading of other organic materials, for example, anionic surfactant, in the base powder is relatively low so that there is some porosity available to take up the sprayed-on nonionic surfactant. However, if the anionic surfactant loading of the base powder is high, the spraying-on of nonionic surfactant will lead to an unacceptable deterioration of flow properties, or even to the "bleeding out" of nonionic surfactant from the powder during storage.

An alternative approach is to prepare a separate granule in which the nonionic surfactant is absorbed into, or adsorbed onto, a carrier material, and to admix the separate granule with the base powder. Highly porous carrier materials such as zeolites and silicas have been proposed in the prior art, for example, JP 08 027 498A (Kao), JP 07 268 398A (Lion), and WO 98 54281A (Unilever). Using such materials it is possible to achieve very high loadings of nonionic surfactant on the carrier, for example, at least 55 wt %.

It has been found, however, that these granular materials, while excellent for detergent compositions intended for use in machine washing, are not ideal for use in compositions intended for low-temperature and/or low-agitation washing conditions, for example, in the handwash, because the solubility and dissolution time may be inadequate.

It has now been discovered that a nonionic surfactant granule having good solubility, high dissolution rate and excellent powder properties may be prepared using, as carrier material, sodium sesquicarbonate formed by in situ neutralisation in the presence of the nonionic surfactant. Although the surfactant loadings achievable are not as high as those obtained with silica carriers, the lower surfactant loadings can be tolerated in formulations where the total content of nonionic surfactant is relatively modest.

It has also been found that compositions containing this nonionic surfactant granule in combination with other granules exhibit improved storage stability of sodium percarbonate bleach.

WO 97 33957A (Amway Corporation) discloses sodium carbonate-based laundry detergent powders of improved solubility, containing a post-added acidulant, for example, adipic, succinic, boric or fumaric acid. Citric acid may additionally be present. Final compositions typically contain 53 wt % sodium carbonate, 22 wt % nonionic surfactant, 7.5 wt % citric acid, and 5 wt % post-added acidulant.

EP 110 588B (Unilever) discloses a free-flowing granular detergent composition comprising a nonionic surfactant, a structuring agent having at least three carboxyl groups (eg citric acid, sodium citrate), and sodium carbonate in very finely divided (micropulverised) form.

WO 93 21292A (Church & Dwight) discloses free-flowing detergent powders containing sodium carbonate, sodium bicarbonate, and low levels of nonionic surfactant (less than 15 wt %).

DEFINITION OF THE INVENTION

The present invention provides a particulate free-flowing laundry detergent composition comprising at least two different granular components:

(a) a granular anionic surfactant component containing at least 25 wt % of sulphonate or sulphate-type anionic surfactant and containing not more than 2 wt % of nonionic surfactant, and (b) a granular nonionic surfactant component comprising (b1) from 20 to 30 wt % of nonionic surfactant, (b2) a non-spray-dried particulate carrier material comprising sodium carbonate together with sodium bicarbonate and/or sodium sesquicarbonate, and the sodium salt of a solid water-soluble organic acid.

A further subject of the invention is a process for the preparation of the nonionic surfactant component defined above, which process comprises mixing and granulating together anhydrous sodium carbonate, a solid water-soluble organic acid in an amount less than the stoichiometric amount required fully to neutralise the sodium carbonate, nonionic surfactant, and water in a high- and/or moderate-shear intensive mixing environment.

A further subject of the invention is a granular nonionic surfactant detergent component prepared by the process as defined in the previous paragraph.

DETAILED DESCRIPTION OF THE INVENTION

The detergent composition of the invention has two essential ingredients: the granular component (a), which contains anionic surfactant and may contain a small proportion of nonionic surfactant; and the granular nonionic surfactant component (b). Additional granular components and other postdosed ingredients may also be present if required or desired.

The Granular Component (a)

The component (a) contains at least 25 wt % of sulphonate- or sulphate-type anionic surfactant. These surfactants are listed in more detail below under "Detergent ingredients", but preferred examples include linear alkylbenzene sulphonate (LAS), primary alcohol sulphate (PAS), and combinations thereof.

Two preferred embodiments of the invention are envisaged. In both embodiments, the composition of the invention preferably contains from 5 to 50 wt % of anionic surfactant, and from 1 to 20 wt % of nonionic surfactant.

According to the first preferred embodiment, the component (a) is a detergent base powder, composed of structured particles containing surfactant, detergency builder, and optionally minor ingredients suitable for incorporation in a base powder (for example, fluorescers, antiredeposition polymers such as sodium carboxymethyl cellulose). The base powder may be spray-dried, prepared by wholly non-tower granulation (also known as agglomeration), or prepared by any combination of these techniques (for example, spray-drying followed by densification).

Preferably the content of anionic surfactant in the base powder is from 25 to 40 wt %. Nonionic surfactant is preferably absent from the base powder, but if present its amount should not exceed 2 wt %, and preferably should not exceed 1 wt %.

In this first embodiment, the laundry detergent composition of the invention may suitably comprise:

from 50 to 98 wt %, preferably from 75 to 98 wt %, of the base powder (a), and from 2 to 30 wt %, preferably from 2 to 20 wt %, of the nonionic surfactant granule (b).

In the first embodiment, the total content of anionic surfactant in the composition as a whole may suitably range from 15 to 50 wt %, preferably from 20 to 50 wt %, and the content of nonionic surfactant may suitably range from 1 to 10 wt %, preferably from 2 to 5 wt %.

Additional postdosed ingredients may be present, for example, bleaches, enzymes, perfume. These are listed in more detail below under "Detergent Ingredients".

According to a second embodiment of the invention, the granule (a) is an anionic surfactant granule having a high loading, preferably at least 40 wt % and more preferably at least 60 wt %, of anionic surfactant. As in the first embodiment, preferred surfactants include linear alkylbenzene sulphonates, primary alcohol sulphates, and mixtures thereof.

Granules of high bulk density containing high levels (at least 60 wt %) of heat-insensitive anionic surfactant (eg LAS, PAS) may be prepared by the flash-drying methods disclosed in WO 96 06916A, WO 96 06917A, WO 97 32002A and WO 97 32005A (Unilever).

Granules of lower bulk density containing at least 40 wt % of alkylbenzene sulphonate are described and claimed in our copending international patent application of even date claiming priority from British Patent Application No. 98 25563.1 filed on Nov. 20, 1998.

This second embodiment of the invention represents a "modular" approach to the formulation of laundry detergent powder, and requires an additional builder granule, as well as the anionic surfactant and nonionic surfactant granules already mentioned.

Builder granules may be based, for example, on sodium tripolyphosphate, or zeolite, or both. They may be prepared by spray-drying, non-tower granulation processes or any suitable combination of these techniques. Builder materials are listed below under "Detergent Ingredients".

In compositions according to the second embodiment, the total amount of anionic surfactant may suitably range from 5 to 50 wt %, preferably from 10 to 40 wt %, and the total amount of nonionic surfactant may suitably range from 5 to 20 wt %.

The compositions of the second embodiment of the invention may also, like those of the first embodiment, contain additional postdosed ingredients, including bleach ingredients.

Compositions according to the second embodiment of the invention may advantageously contain postdosed sodium percarbonate, ie sodium percarbonate present as separate granules. It has been found that the storage stability of sodium percarbonate in compositions according to the second embodiment of the invention is better than that of traditional non-"modular" compositions, and better than that of "modular" compositions containing some other nonionic surfactant granules.

Sodium percarbonate is suitably present in an amount of from 5 to 35 wt %, preferably from 10 to 25 wt %, based on the whole composition. The sodium percarbonate granules may have a protective coating against destabilisation by moisture, for example, a coating comprising sodium metaborate and sodium silicate as disclosed in GB 2 123 044B (Kao).

The Nonionic Surfactant Granule (b)

The nonionic surfactant granule (b) comprises:

(b1) from 20 to 30 wt % of nonionic surfactant, (b2) a non-spray-dried particulate carrier material comprising sodium carbonate together with sodium bicarbonate and/or sodium sesquicarbonate, and the sodium salt of a solid water-soluble organic acid.

The carrier used in this granule is based on sodium sesquicarbonate which is prepared by in-situ neutralisation of sodium carbonate by a water-soluble organic acid, for example, citric acid, during a granulation process, in the presence of the nonionic surfactant to be carried.

The reaction of sodium carbonate with citric acid and water to bicarbonate and further to sesquicarbonate can be represented by the following equation:

$$3Na_2CO_3+H_3(C_6H_5O_7)+H_2O \rightarrow Na_2CO_3.NaHCO_3.2H_2O+Na_3(C_6H_5O_7)+CO_2$$

Sesquicarbonate is a hydrated crystalline solid. Without wishing to be bound by theory, it is believed that if this reaction takes place during a granulation process, strong granules are formed in which primary particles are bound together by crystal growth.

The present inventors have found that if the stoichiometric amount of the organic acid is used, the resulting granular product is very hygroscopic and has a high tendency to cake. However, if less than the stoichiometric amount of the acid is used, so that only part of the sodium carbonate is converted, a free-flowing crisp granulate is obtained.

The nonionic surfactant component (b) preferably comprises at least 50 wt %, in total, of sodium carbonate and sodium bicarbonate and/or sesquicarbonate.

The water-soluble organic acid used for the in-situ neutralisation process survives into the granular product in sodium salt form. The solid water-soluble organic acid is preferably a monomeric di- or tri-carboxylic acid, or a polymeric polycarboxylic acid. Monomeric acids may, for example, be selected from citric acid, succinic acid, tartaric acid, and mixtures such as Sokalan (Trade Mark) DCS from BASF. Polymeric acids include polyacrylic acids and acrylic/maleic copolymers.

The nonionic surfactant in the granular component is preferably a $C_8$–$C_{22}$ aliphatic alcohol having an average degree of ethoxylation of from 1 to 10, preferably a $C_{10}$–$C_{16}$ alcohol having an average degree of ethoxylation of from 2 to 8. The granular component is especially suitable for carrying and delivering to the wash relatively insoluble or hydrophobic ethoxylated nonionic surfactants, ie materials having an HLB (hydrophilic/lipophilic balance) value of 10 or less, in which the degree of ethoxylation is low in relation to the chain length. For these nonionic surfactants, insoluble carriers such as silicas or zeolites do not give sufficiently complete or rapid dissolution under wash conditions of low temperature and/or low agitation. Examples of such nonionic surfactants include $C_9$–$C_{11}$, alcohols having an average degree of ethoxylation of from 1 to 3, and $C_{12}$–$C_{16}$ alcohols having an average degree of ethoxylation of from 2 to 5.

Preparation of the Nonionic Surfactant Granule (b)

The process for the preparation of the nonionic surfactant granule comprises mixing and granulating together anhydrous sodium carbonate, a solid water-soluble organic acid in an amount less than the stoichiometric amount required fully to neutralise the sodium carbonate, nonionic surfactant, and water in a high- and/or moderate-shear intensive mixing environment.

Suitably the organic acid is used in an amount of less than 50 wt % of the stoichiometric amount, and preferably from 20 to 35 wt % of the stoichiometric amount. For example, it has been found that a good powder has been obtained using 73 wt % light soda ash (anhydrous sodium carbonate), 12 wt % anhydrous citric acid and 15 wt % water; in this case approximately 27 wt % of the sodium carbonate is reacting. These percentages are based on the carrier without the nonionic surfactant.

In general, the starting materials are preferably used in the following proportions (weight%) based on the total granular material including the nonionic surfactant:

| | |
|---|---|
| Anhydrous sodium carbonate | 50–70 |
| Solid water-soluble organic acid | 5–15 |
| Nonionic surfactant | 20–30 |
| Water | 5–15 |

Preparation of this granular product requires intensive mixing in a high-shear or moderate-shear environment, for example, a high-speed or moderate-speed mixer/granulator. Examples of suitable apparatus include the Lödige KM or FM Ploughshare (moderate speed, batch or continuous), the Lödige CB series (high speed, continuous), and the Fukae FS series granulator (high speed, batch). A combination of a high speed mixer and a moderate speed mixer, for example, a Recycler followed by a Ploughshare, may also be used.

The process may typically be conducted as follows. The anhydrous sodium carbonate (preferably in the form of light soda ash) and the solid organic acid are dry mixed in one of the mixers mentioned above; the nonionic surfactant is added while the mixer is operated; then, after sufficient time has elapsed for the nonionic surfactant to be thoroughly distributed over the solids, water is added to start the granulation process. The mixer is operated at a moderate agitation speed during granulation. The reaction is exothermic and a considerable temperature rise will be observed. A wet and pasty intermediate stage is sometimes observed, but, after a total granulation time typically of 30 seconds to 5 minutes, a dry strong granular product is formed. Advantageously the product can be dried further, for example, in a fluidised bed.

Thus the process preferably comprises the following steps:

(i) intimately mixing together the anhydrous sodium carbonate and the solid water-soluble organic acid and the nonionic surfactant in a high- and/or moderate-shear intensive mixing environment, (ii) admixing water and allowing the mixture to granulate, (iii) optionally drying the granular product thus obtained in a fluidised bed.

Detergent Ingredients

The finished laundry detergent composition of the invention, whether containing a base powder or whether entirely modular, will generally contain detergent ingredients as follows.

As previously indicated, the detergent compositions will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Amphoteric surfactants, for example, amine oxides, and zwitterionic surfactants, for example, betaines, may also be present.

As previously indicated, the quantity of anionic surfactant is in preferably within the range of from 5 to 50% by weight.

Nonionic surfactant is preferably used in an amount within the range of from 1 to 20% by weight.

The compositions may suitably contain from 10 to 80%, preferably from 15 to 70% by weight, of detergency builder.

Preferably, the quantity of builder is in the range of from 15 to 50% by weight.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminum zeolite P (zeolite MAP) as described and claimed in EP 384 070B (Unilever), and commercially available as Doucil (Trade Mark) A24 from Crosfield Chemicals Ltd, UK. Zeolite MAP is defined as an alkali metal aluminosilicate of zeolite P type having a silicon to aluminum ratio not exceeding 1.33, preferably within the range of from 0.90 to 1.33, preferably within the range of from 0.90 to 1.20.

Especially preferred is zeolite MAP having a silicon to aluminum ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Builders are normally wholly or predominantly included in the granular components, either in the base powder or in a separate builder granule.

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

The peroxy bleach compound, for example sodium percarbonate, is suitably present in an amount of from 5 to 35 wt %, preferably from 10 to 25 wt %. The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N, N, N', N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as "Carezyme").

Detergency enzymes are commonly employed in granular form in amounts of from about 0.1 to about 3.0 wt %. However, any suitable physical form of enzyme may be used. Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokalan (Trade Mark) HP22. Especially preferred soil release polymers are the sulphonated non-end-capped polyesters described and claimed in WO 95 32997A (Rhodia Chimie).

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

The detergent composition may contain water-soluble alkali metal silicate, preferably sodium silicate having a $SiO_2$:$Na_2O$ mole ratio within the range of from 1.6:1 to 4:1.

Other materials that may be present in detergent compositions of the invention include fluorescers; photobleaches; inorganic salts such as sodium sulphate; foam control agents or foam boosters as appropriate; dyes; coloured speckles; perfumes; and fabric conditioning compounds.

Ingredients which are normally but not exclusively postdosed, may include bleach ingredients, bleach precursor, bleach catalyst, bleach stabiliser, photobleaches, water-soluble crystalline or amorphous alkaline metal silicate, layered silicates, anti-redeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

EXAMPLES

The invention will now be further illustrated by the following non-limiting Examples, in which parts and percentages are by weight unless otherwise stated.

In the Examples the following test methods were used:

Dynamic Flow Rate (DFR)

The dynamic flow-rate or DFR is measured by the following method. The apparatus used consists of a cylindrical glass tube having an internal diameter of 35 mm and a length of 600 mm. The tube is securely champed in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained.

Solubility Measurement 5 g of the powder under investigation is dosed into 500ml of water contained in 1000 ml beaker at a temperature of 20° C. The water is stirred with a magnetic stirring rod of 6cm maintaining a 4 cm vortex for 2 minutes after which the solution is poured over a filter with a mesh size of 125 pm. The filter with residue is dried at 800C in an oven for an hour after which the amount of residue is weighed. The amount of insolubles is calculated by:

$$\text{Insolubles [\%]} = \frac{\text{Amount of residue [g]}}{\text{Amount of initial powder [g]}} \times 100\,\%$$

Rate of Dissolution

A 1.25 g sample of the granules is dissolved in 500 ml of water with stirring, and the conductivity of the solution as a function of time is recorded. The test is continued until the conductivity has reached a constant value. The measure for the rate of dissolution is taken to be $t_{90}$, the time (in seconds) taken to reach 90% of the final conductivity value.

Example 1

Nonionic Surfactant Granules Prepared by Continuous Process in Moderate Speed Mixer/granulator The following ingredients were dosed into a 50-litre L ödige ploughshare: the total batch weight was 13–15 kg.

56.4 wt % sodium carbonate (light soda ash) and 9.3 wt % citric acid were mixed together, after which 22.7 wt % nonionic surfactant (Lutensol (Trade Mark) A7 ex BASF: $C_{12}$–$C_{15}$ 7EO) was added. After the nonionic surfactant had been distributed well, 11.6 wt % water was added, followed by approximately 5 minutes of granulation. During the process a considerable temperature rise was observed. The resulting powder was cooled and powder properties were assessed.

The following properties were recorded:

| | |
|---|---|
| Bulk density [g/l] | 930 |
| Dynamic flow rate [ml/s] | 130 |
| Insolubles [wt %] | 0 |
| Dissolution time $t_{90}$ [sec] | 10–15 |

Examples 2 to 4

Nonionic Surfactant Granules Produced by a Batch Process

The same formulation as described in Example 1 was produced in a Fukae FS30 granulator.

Sodium carbonate and citric acid powder were mixed and heated to 55° C., then the nonionic surfactant was mixed in to coat the solids. The water was then added, followed by approximately 1 minute of granulation at an impeller speed of 150 rpm and a chopper speed of 3000 rpm. The process was carried out three times to produce three batches of granular product having the following properties

| Example | Bulk density (g/l) | Dynamic flow rate (ml/s) |
|---|---|---|
| 2 | 764 | 141 |
| 3 | 720 | 136 |
| 4 | 661 | 104 |

Example 5

Nonionic Surfactant Granules Prepared by Continuous Process using High-speed and Moderate-speed Mixer/granulators A continuous trial was carried out using a Lödige CB30 Recycler, followed by a Lödige KM300 ploughshare, a fluid bed and a 2mm screen.

For this example, a nonionic surfactant having an especially low degree of ethoxylation, Lutensol AO3 ex BASF ($C_{12}$–$C_{15}$ 3EO) was used.

Sodium carbonate, citric acid and nonionic surfactant were dosed continuously into the CB30 Recycler, which was operated at 1500 rpm. The resulting material was fed into the KM300 ploughshare, in which water was added continuously. The resulting powder exiting from the KM300 was cooled in the fluid bed, screened and collected.

A granular product containing approximately 21 wt % nonionic surfactant was produced in this manner using the mixture of starting raw materials shown in the table below, which also gives properties.

| | weight % |
|---|---|
| Sodium carbonate | 62.8 |
| Citric acid | 8.1 |
| Nonionic surfactant 3EO | 20.9 |
| Water | 8.2 |
| Bulk density | 730 g/l |
| Dynamic flow rate | 125 ml/s |

Examples 6 to 16

Comparative Examples A to C Nonionic Surfactant Granules

A control granule (Comparative Example A) using a water-insoluble (silica) carrier was prepared as follows.

The process route consisted of a Lödige CB30 Recycler, followed by a Niro fluid bed and a Mogensen sieve. The L ödige CB30 was operated at 1500 rpm. Water was used to cool the CB30 jacket during the process. The air flow in the Niro fluid bed was 900–1000 $m^3$/hr. The total flow of powder exiting the process was in the order of 600 kg/h. A highly porous silica, Sorbosil (Trade Mark) $TC_{15}$ ex Crosfield, was continuously dosed into the CB30, into which also a mixture of nonionic surfactant (Synperonic (Trade Mark) A7 ex ICI, $C_{12}$–$C_{15}$ 7EO) and fatty acid (Pristerene (Trade Mark) 4916 ex Unichema) was dosed via dosing pipes. At the same time a 50% NaOH solution was dosed. This set of solid and liquid materials was mixed and granulated in the CB30 after which the resulting powder was entered in the fluid bed cooled. Fines were filtered from the air stream with a cyclone and filter bags. Coarse particles (>1400 $\mu$m) were separated from the product by the Mogensen sieve.

The resulting granular product had the following formulation and properties:

| Comparative Example A | wt % |
|---|---|
| Silica: Sorbosil TC15 | 33.6 |
| Nonionic surfactant 7EO | 55.6 |
| Soap | 9.8 |
| Water | 1 |

Nonionic surfactant granules (Examples 6 to 14 in accordance with the invention, Comparative Examples B and C) were also produced using the processes of Examples 1 to 5:

Examples 6 to 14: using $C_{12}$–$C_{15}$ 7EO nonionic surfactant (Lutensol AO7), HLB value 12.2:

| | Sodium carbonate [%] | Citric acid (anh.) [%] | Nonionic surfactant [%] | Water [%] | Dissolution residue [%] | Dissolution time $t_{90}$ [sec] |
|---|---|---|---|---|---|---|
| B | 51.87 | 20.75 | 20.75 | 6.64 | | |
| C | 44.59 | 27.39 | 25.48 | 2.55 | 0.4 | 20 |
| 6 | 56.66 | 9.92 | 22.10 | 11.33 | 0.0 | 17 |
| 7 | 56.39 | 9.77 | 22.56 | 11.28 | | |
| 8 | 57.69 | 7.69 | 23.08 | 11.54 | | |
| 9 | 58.65 | 7.62 | 23.46 | 10.26 | | |
| 10 | 56.82 | 7.58 | 24.24 | 11.36 | 0.0 | |
| 11 | 58.14 | 7.75 | 24.81 | 9.30 | | |
| 12 | 57.47 | 7.66 | 24.90 | 9.96 | | |
| 13 | 54.55 | 9.45 | 25.09 | 10.91 | | |
| 14 | 60.25 | 6.89 | 26.83 | 6.03 | | |

Examples 15 and 16: using $C_{12}$–$C_{15}$ 3EO nonionic surfactant (Lutensol AO3), HLB value 7.8

| | Sodium carbonate [%] | Citric acid (anh.) [%] | Nonionic surfactant [%] | Water [%] | Dissolution residue [%] | Dissolution time $t_{90}$ [sec] |
|---|---|---|---|---|---|---|
| 15 | 62.79 | 8.14 | 20.93 | 8.14 | 0.3 | 19 |
| 16 | 56.39 | 9.77 | 22.56 | 11.28 | | |

Comparative Example A had a dissolution residue of 4.5%, indicating the superiority of the nonionic surfactant granules of the invention. It will be noted that even the granule containing 3EO nonionic surfactant had excellent dissolution properties.

Comparative Examples B and C, prepared using higher proportions of citric acid, had good dissolution properties, but exhibited severe caking problems.

The nonionic surfactant level was analytically determined for Examples 7 and 10:

| | |
|---|---|
| Example 7 | 24.7% |
| Example 10 | 26.8% |

Examples 17 to 21

Detergent Compositions

These Examples disclose fully formulated laundry detergent compositions in accordance with the present invention.

Various base powders and other granular components were produced, as follows.

Base powder F1: spray-dried phosphate base

A slurry was prepared by mixing water, NaOH solution, linear alkylbenzene sulphonic acid (LAS acid), sodium tripolyphosphate (STP), sodium sulphate and sodium alkaline silicate. The slurry was spray-dried in a spray-drying tower at a rate of 1100 kg/h using an outlet air temperature of approximately 115–120° C. The resulting powder was cooled and collected. Powder F1had the following formulation:

| Base powder F1 | wt % |
|---|---|
| STP | 28.3 |
| NaLAS | 27.8 |
| Sodium silicate | 11.0 |
| Sodium sulphate | 21.0 |
| Moisture, minors etc | 11.8 |

Base powder F2: non-tower phosphate base

This powder was prepared by dosing STP, sodium carbonate and LAS acid into a Fukae FS30 granulator. The solids were pre-mixed after which the LAS acid was added and the powder was granulated using an impeller speed of 100 rpm and a chopper speed of 3000 rpm until satisfactory granules were formed. At the end of the process the granules were layered with zeolite 4A. The following formulation was formed by this process:

| Base powder F2 | wt % |
|---|---|
| STP | 45.2 |
| Zeolite (anhydr) | 2.4 |
| NaLAS | 26.7 |
| Sodium carbonate | 18.2 |
| Moisture, minors etc | 7.5 |

Builder granule B1: spray-dried phosphate granule

This was produced by spray-drying a slurry containing water, STP, NaLAS and silicate, in a spray-drying tower, at a rate of 1100 kg/h using an outlet air temperature of approximately 115–120° C. The resulting powder was cooled and collected. Builder granule B1 had the following formulation:

| Builder granule B1 | wt % |
|---|---|
| STP | 75.0 |
| NaLAS | 2.0 |
| Sodium silicate | 5.0 |
| Moisture, minors etc | 18.0 |

Builder granule B2: non-tower phosphate granule

Builder granule B2 was produced by granulating STP and acrylate/maleate copolymer (Sokalan (Trade Mark) CP5 ex BASF) solution in a fluidised bed. The STP was fluidised, while at the same time a 10% solution of Sokalan CP5 was added at a rate of 400 g/min. In this way a free flowing builder granule was formed with the following composition.

| Builder granule B2 | wt % |
|---|---|
| STP | 68.2 |
| Acrylate/maleate copolymer | 4.3 |
| Moisture, etc. | 27.5 |

Builder granule B3: non-tower zeolite/citrate/polymer granule

This was produced by continuously dosing zeolite MAP (Doucil A24 ex Crosfield), granular trisodium citrate and 40% acrylate/maleate copolymer (Sokalan CP5 ex BASF) solution into a Lödige CB30 recycler. The CB30 was operated at 1500 rpm. The exiting powder was led through a Lödige KM300 ploughshare (120 rpm), in which densification took place. The resulting powder was dried in a fluid bed. The composition of the resulting builder granule was:

| Ingredients [wt %] | B3 |
|---|---|
| Zeolite MAP (anh) | 41.6 |
| Trisodium citrate | 31.3 |
| Acrylate/maleate copolymer | 12.2 |
| Water etc. | 14.9 |

Linear alkylbenzene sulphonate (LAS) granules A1 (prepared by in-situ non-tower neutralisation)

These granulares were produced in a dryer/granulator from VRV SpA, Italy. LAS acid was neutralised with sodium carbonate as follows. Sodium linear alkyl benzene sulphonate particles (NaLAS) were produced by neutralising LAS acid with sodiumcarbonate. Furthermore, zeolite 4A and zeolite MAP were dosed as well. A 2 $m^2$ VRV flash-drier machine was used having three equal jacket sections. Dosing ports for liquids and powders were situated just prior to the first hot section, with mid-jacket dosing ports available in the final two sections. Zeolite MAP was also added via this port in the final section for layering purposes. An electrically-powered oil heater provided the heating to the first two jacket sections. Ambient process water at 15° C. was used for cooling the jacket in the final section. Make-up air flow through the reactor was controlled between 10 and 50 $m^3$/kg hr by opening a bypass on the exhaust vapour extraction fan. All experiments were carried out with the motor at full-speed giving a tip speed of about 30 m/s. The sodium carbonate, zeolite 4A and LAS acid were added just prior to the first hot section and zeolite MAP layering was added into the third section which was cold.

A jacket temperature of 145° C. was used in the first two sections, with an estimated throughput of components 60–100 kg/hr. A degree of neutralisation of alkylbenzene sulphonate of >95% was achieved. The granules had the following composition:

| Composition [wt %] | A1 |
|---|---|
| NaLAS | 70 |
| Zeolite 4A | 20 |
| Zeolite MAP | 5 |
| Moisture, etc | 5 |

Nonionic surfactant granule N1 was the nonionic surfactant granule of Example 1.

Nonionic surfactant granule N5 was the nonionic surfactant granule of Example 5.

Detergent compositions

| Example | 17 | 18 | 19 | 20 | 21 |
|---|---|---|---|---|---|
| F1 | | | 51.2 | | |
| F2 | | | | | 65.77 |
| B1 | | | | 26.7 | |
| B2 | 32.7 | | | | |
| B3 | | 19.51 | | | |
| A1 | 8.4 | 12.4 | 11.1 | 27.8 | 15 |
| N1 | 29.6 | 30.3 | | 15.2 | 17.3 |
| N5 | | | 12.0 | | |
| Dense sodium carbonate | | | 10.7 | 9.5 | |
| Sodium sulphate | 6.07 | | 13.86 | 19.66 | 0.26 |
| Sodium perborate tetrahydrate | 18.00 | | | | |
| Sodium percarbonate | | 19 | | | |
| TAED | 2 | 5.5 | | | |
| Antifoam granule | 0.8 | 1.7 | | | |
| Sodium carboxymethyl cellulose (80%) | 0.26 | 0.54 | | | |
| Fluorescer granule (15%) | 0.53 | 1.3 | | | |
| Soil release polymer granules* | 0.21 | 1.5 | | | |
| Polyvinyl pyrrolidone granules | 0.1 | 0.4 | | | |
| Carbonate/silicate granules** | | 5.5 | | | |
| EDTMP*** | 0.5 | 1 | | | 0.46 |
| Blue speckles | | | | | 0.2 |
| Green speckles | | | | | 0.2 |
| Protease (Purafect 2100G) | | | | | 0.31 |
| Protease (Savinase) | 0.36 | 0.78 | | | |
| Savinase | | | 0.754 | 0.754 | |
| Lipolase | 0.025 | 0.12 | 0.166 | 0.166 | 0.1 |
| Amylase (Termamyl) | 0.25 | | | | |
| Perfume | 0.19 | 0.45 | 0.22 | 0.22 | 0.4 |
| Bulk density [g/l] | 667 | 837 | | | |
| Flow rate [ml/s] | 136 | 126 | | | |

*Sokalan (Trade Mark) HP23 ex BASF
**Nabion (Trade Mark) 15 ex Rhodia
***Dequest (Trade Mark) 2047 ex Monsanto Example 22, Comparative Examples D to F Sodium Percarbonate Stability The following powders and granules were used to prepare detergent compositions containing sodium percarbonate.

Base powder F3: non-tower zeolite base

A base powder was prepared by non-tower granulation using a Lödige CB30 Recycler followed by a Lödige ploughshare, to the following formulation (parts by weight):

| | |
|---|---|
| Sodium LAS | 8.68 |
| Nonionic surfactant 7EO | 4.55 |
| Nonionic surfactant 3EO | 2.44 |
| Soap | 1.12 |
| Zeolite MAP | 29.63 |
| Sodium citrate dihydrate | 3.49 |
| Light sodium carbonate | 5.82 |
| Sodium carboxymethyl cellulose (68%) | 0.54 |
| Water, salts etc to | 61.04 |

Builder granule B3: non-tower zeolite/citrate/copolymer granules as used in previous Examples.

Anionic surfactant granule A1: 70% LAS granules as used in previous Examples.

Nonionic surfactant granule N1: the granule of Example 1.

Nonionic surfactant granule NX: non-tower zeolite/citrate/soap granule

Nonionic surfactant granule NX was made by continuously dosing zeolite MAP, granular trisodium citrate, 50% NaOH solution and a mixture of nonionic surfactant (Lutensol AO7) and fatty acid (Pristerene 4916 ex Unichema) into a Lödige CB30 recycler. The CB30 was operated at 1500 rpm. The exiting powder was led through a Lödige KM300 ploughshare (120 rpm), in which densification took place. The resulting product was cooled in a fluid bed. The composition of the resulting granule was:

| Ingredients [wt %] | NX |
|---|---|
| Zeolite MAP (anh) | 56.5 |
| Soap | 4.1 |
| $C_{12}$-$C_{15}$ nonionic surfactant 7EO | 24.1 |
| Trisodium citrate | 8.1 |
| Water etc. | 7.2 |

Detergent Compositions with Sodium Percarbonate

The full formulations were as shown in the following table.

Example 22 was a "modular" formulation in accordance with the present invention, containing anionic surfactant granules, nonionic surfactant granules, and builder granules.

Comparative Example D was a partially "modular" formulation containing anionic surfactant granules, a nonionic surfactant granule (nonionic surfactant on zeolite MAP) serving also as a builder granule, and a substantial content of sodium carbonate.

Comparative Example E was a wholly "modular" formulation containing anionic surfactant granules, nonionic surfactant granules and separate builder granules, but the nonionic surfactant granules (based on zeolite MAP) were outside the scope of the present invention.

Comparative Example F was a "traditional" formulation containing a base powder.

| | 22 | D | E | F |
|---|---|---|---|---|
| "Base" ingredients | | | | |
| F3 | | | | 61.04 |
| B3 | 17.26 | 0.00 | 15.90 | |
| N1 | 31.05 | | | |
| NX | | 29.00 | 29.00 | |

-continued

| | 22 | D | E | F |
|---|---|---|---|---|
| A1 | 14.19 | 14.19 | 14.19 | |
| Sodium carbonate (dense) | 0.00 | 18.31 | 3.41 | |
| Postdosed ingredients | | | | |
| Sodium percarbonate | 19.00 | 19.00 | 19.00 | 19.00 |
| TAED | 5.50 | 5.50 | 5.50 | 5.50 |
| Antifoam granule | 1.70 | 1.70 | 1.70 | 1.70 |
| Sodium carboxymethyl cellulose | 0.54 | 0.54 | 0.54 | 0.00 |
| Fluorescer granule | 1.30 | 1.30 | 1.30 | 1.30 |
| Polyvinyl pyrrolidone | 0.10 | 0.10 | 0.10 | 0.10 |
| Soil release polymer granule* | 1.50 | 1.50 | 1.50 | 1.50 |
| Acrylate/maleate copolymer granule**** | 0.00 | 1.00 | 0.00 | 1.00 |
| Carbonate/silicate granule** | 5.50 | 5.50 | 5.50 | 5.50 |
| Sodium bicarbonate | 0.00 | 0.00 | 0.00 | 1.00 |
| Dense sodium carbonate | 0.46 | 0.46 | 0.46 | 0.46 |
| EDTMP*** | 1.00 | 1.00 | 1.00 | 1.00 |
| Protease (Savinase 12.0T) | 0.78 | 0.78 | 0.78 | 0.78 |
| Lipolase 100 T | 0.12 | 0.12 | 0.12 | 0.12 |

*Sokalan (Trade Mark) HP23 ex BASF
**Nabion (Trade Mark) 15 ex Rhodia
***Dequest (Trade Mark) 2047 ex Monsanto
****Sokalan (Trade Mark) CP5 ex BASF For the storage test, 20 g samples of each powder were put into small plastic tubs (margarine tubs), ensuring that the powder was spread out as a thin layer on the bottom of the tub. Each tub was closed with a plastic lid in which 15 small holes had been punched, evenly distributed over the lid surface, to allow ingress of moisture vapour. The tubs were stored at 37° C. and a relative humidity of 70%. After defined time intervals, two tubs of each powder were taken out of the climate cell and analysed for available oxygen, as a measure of remaining percarbonate. The results of both samples were averaged.

The following results for available oxygen level (as percentage of original level) were obtained.

| | Storage time [days] | | | | |
|---|---|---|---|---|---|
| Example | 0 | 6 | 12 | 19 | 27 |
| 22 | 100 | 86.2 | 68.8 | 54.3 | — |
| D | 100 | 85.2 | 61.9 | 44.7 | — |
| E | 100 | 87.2 | 61.6 | — | 27.5 |
| F | 100 | — | 58.8 | 43.9 | 24.8 |

We claim:

1. A particulate free-flowing laundry detergent composition comprising at least two different granular components:

(a) a granular anionic surfactant component containing at least 25 wt % of sulphonate or sulphate anionic surfactant and containing not more than 2 wt % of nonionic surfactant, and (b) a granular nonionic surfactant component comprising (b1) from 20 to 30 wt % of nonionic surfactant, (b2) a non-spray-dried particulate carrier material comprising sodium carbonate together with sodium bicarbonate and/or sodium sesquicarbonate, and the sodium salt of a solid water-soluble organic acid.

2. A detergent composition as claimed in claim 1, wherein the nonionic surfactant component (b) comprises at least 50 wt %, in total, of sodium carbonate and sodium bicarbonate and/or sesquicarbonate.

3. A detergent composition as claimed in claim 1, wherein in the nonionic surfactant component (b) the sodium salt of a solid water-soluble organic acid is a sodium salt of a di- or tricarboxylic acid or a polymeric polycarboxylic acid.

4. A detergent composition as claimed in claim 3, wherein in the nonionic surfactant component (b) the sodium salt of a solid organic acid is a sodium salt of an acid selected from the group consisting of citric acid, succinic acid, tartaric acid, polyacrylic acid, acrylic/maleic acid copolymer, and mixtures thereof.

5. A detergent composition as claimed in claim 1, wherein the nonionic surfactant in the nonionic surfactant component (b) is a $C_{10}$–$C_{16}$ aliphatic alcohol having an average degree of ethoxylation of from 2 to 8.

6. A detergent composition as claimed in claim 1, wherein the nonionic surfactant has an HLB value not exceeding 10.

7. A detergent composition as claimed in claim 1, which comprises:

(a) a detergent base powder composed of structured particles comprising anionic surfactant, builder, optionally nonionic surfactant and optionally other detergent ingredients, and having an anionic surfactant content of at least 25 wt % and containing not more than 2 wt % of nonionic surfactant, and (b) the nonionic surfactant component.

8. A detergent composition as claimed in claim 7, which comprises from 50 to 98 wt % of the detergent base powder (a), and from 2 to 30 wt % of the granular nonionic surfactant component (b).

9. A detergent composition as claimed in claim 7, wherein the base powder (a) contains from 25 to 40 wt % of anionic surfactant.

10. A detergent composition as claimed in claim 7, which contains from 15 to 50 wt % of anionic surfactant, and from 1 to 10 wt % of nonionic surfactant.

11. A detergent composition as claimed in claim 1, which comprises:

(a) an anionic surfactant component containing at least 40 wt %, preferably at least 60 wt %, of sulphonate or sulphate anionic surfactant and containing not more than 2 wt % of nonionic surfactant, (b) the nonionic surfactant component, and (c) a builder granule.

12. A detergent composition as claimed in claim 11, which contains from 5 to 50 wt % of anionic surfactant and from 1 to 20 wt % of nonionic surfactant.

13. A detergent composition as claimed in claim 1, which further comprises separate particles of sodium percarbonate.

14. A process for the preparation of a free-flowing granular detergent component comprising (b1) from 20 to 30 wt % of nonionic surfactant, (b2) a non-spray-dried particulate carrier material comprising sodium carbonate together with sodium bicarbonate and/or sodium sesquicarbonate, and the sodium salt of a solid water-soluble organic acid, which comprises mixing and granulating together anhydrous sodium carbonate, a solid water-soluble organic acid in an amount less than the stoichiometric amount required fully to neutralise the sodium carbonate, nonionic surfactant, and water in a high- and/or moderate-shear intensive mixing environment.

15. A process as claimed in claim 14, wherein the solid water-soluble organic acid is used in an amount not exceeding 50 wt % of the stoichiometric amount.

16. A process as claimed in claim 14, which comprises mixing and granulating:

(i) from 50 to 70 wt % of anhydrous sodium carbonate, (ii) from 5 to 15 wt % of the solid water-soluble organic acid, the amount being less than the stoichiometric amount required fully to neutralise the sodium carbonate, (iii) from 20 to 30 wt % of nononic surfactant, (iv) from 5 to 15 wt % of water.

17. A process as claimed in claim 14, which comprises the steps of:

(i) intimately mixing together the anhydrous sodium carbonate, the solid water-soluble organic acid and the nonionic surfactant in a high- and/or moderate-shear intensive mixing environment, (ii) admixing water and allowing the mixture to granulate.

18. A free-flowing granular detergent component comprising (b1) from 20 to 30 wt % of nonionic surfactant, (b2) a non-spray-dried particulate carrier material comprising sodium carbonate together with sodium bicarbonate and/or sodium sesquicarbonate, and the sodium salt of a solid water-soluble organic acid, prepared by a process as claimed in claim 14.

* * * * *